United States Patent [19]

Saito

[11] 3,989,055

[45] Nov. 2, 1976

[54] FOLDING UMBRELLA

[76] Inventor: Kazo Saito, No. 9-374, Otorinaka, Sakai, Osaka, Japan

[22] Filed: Aug. 15, 1975

[21] Appl. No.: 605,045

[30] Foreign Application Priority Data

Aug. 16, 1974 Japan ..... 49-93230

[52] U.S. Cl. ..... 135/25 A; 135/22; 135/25 R

[51] Int. Cl.[2] ..... A45B 25/14; A45B 25/16

[58] Field of Search ..... 135/25 R, 25 A, 22

[56] References Cited

UNITED STATES PATENTS

| | | | |
|---|---|---|---|
| 2,649,103 | 8/1953 | Militano | 135/25 R |
| 2,761,461 | 9/1956 | Mappin et al. | 135/25 R |
| 3,850,188 | 11/1974 | Saito | 135/22 X |

*Primary Examiner*—Werner H. Schroeder
*Assistant Examiner*—Conrad L. Berman
*Attorney, Agent, or Firm*—Woodhams, Blanchard and Flynn

[57] ABSTRACT

A folding umbrella having a rib assembly wherein an end rib is connected to a main rib through a connecting link, an auxiliary link is connected between the end rib and the main rib and adapted to be foldable with its articulate structure and a strut connected at its outer end to one of the connecting link, the end rib and the auxiliary link. With this rib assembly, the umbrella is capable of being closed into two positions, namely, a collapsed storage position and an uncollapsed extended position, and is capable of being contracted easily and smoothly from said uncollapsed position to the collapsed position.

6 Claims, 8 Drawing Figures

FOLDING UMBRELLA

FIELD OF THE INVENTION

This invention relates to a folding umbrella having a rib assembly with an end rib spaced from a main rib and connected thereto through a connecting link and capable of being closed into two positions, namely, a collapsed storage position and an extended or uncollapsed position, and more particularly, to a folding umbrella of this kind which is capable of being moved easily and smoothly from its extended closed position to its collapsed closed position.

BACKGROUND OF THE INVENTION

A conventional umbrella of this type as disclosed, for example, in U.S. Pat. No. 3,850,188 has a rib assembly as shown in FIGS. 1 through 4. The umbrella with such rib assembly is capable of being closed in an extended state without collapsing the rib structure for putting the umbrella against an umbrella stand or resting it against a wall etc. when the umbrella is temporarily closed in a standby state for further use and capable of being collapsed into a compact form convenient for storage and handy for carrying when it is not in use. This conventional umbrella, however, has some difficulty in collapsing operation from its extended closed position to its collapsed closed position.

In FIGS. 1 through 4, showing a conventional umbrella of this type with an automatic opening means, numeral 1 designates a known contractile or telescopic center rod and numeral 2 a ferrule which is fixedly secured to the center rod 1 directly adjacent the upper end thereof. A runner 5 is slidably mounted on said center rod 1 intermediate the ends thereof. A main rib 3 is pivotally connected at its upper end to said ferrule 2 and at its lower end to the inner end of an auxiliary link 8. The outer end of said auxiliary link 8 is connected to the intermediate portion of an end rib 6. Said end rib 6 is spaced from said main rib 3 and connected thereto at its intermediate portion through a connecting link 7. A strut 4 is pivotally connected at its inner end to the runner 5 and at its outer end to the pivotal joint of the auxiliary link 8 and the end rib 6. The strut 4 may alternatively be pivotally connected at its outer end to the auxiliary link 8, the connecting link 7 or the end rib 6, or the pivotal joint of the end rib 6 and the connecting link 7.

Numeral 9 designates an actuator slidably mounted on the center rod 1 under the runner 5. A compression spring 10 rests at its upper end against said runner 5 and at its lower end against said actuator 9. An actuator strut 11 is pivotally connected at its lower end to the actuator 9 and at its upper end to the strut 4 intermediate the ends thereof. Numeral 12 designates a lock means having a detent 12*a* to lock the automatic opening means and 13 a means for receiving the tip end of the end rib 6.

In the thus constructed structure, when the actuator 9 is lowered by hand from the opened position as shown in FIG. 1, the umbrella is closed into an uncollapsed position as shown in FIG. 2. When the umbrella is further required to be collapsed into a position, as shown in FIG. 4, the operation for moving the rib assembly from the uncollapsed closed position to the collapsed closed position undergoes some difficulty as mentioned above.

Stated illustratively, in the uncollapsed or extended closed position, the strut 4 undergoes a force acting to expand the strut 4 by the action of the compression spring 10 so that when the lock means 12 is operated to release the locking of the actuator 9, the automatic opening means is immediately actuated only to release the rib assembly to its original opened position, as shown in FIG. 1, failing to move the rib assembly into the intended collapsed closed position, as shown in FIG. 4. Accordingly, in order to move the rib assembly from the uncollapsed closed position of FIG. 2 to the collapsed closed position of FIG. 4, the operation must be done while grasping the main ribs 3, which are arranged around the center rod 1, by hand to press them inwardly, or holding or gripping the struts, which are also arranged around the center rod 1, to kill the expanding force of the automatic opening means in the position of FIG. 2. At this time, the rib assembly may be comparatively easily contracted by applying a force A in the arrow direction and a force B in the arrow direction. In this case, however, in the course of the movement of the rib assembly to the collapsed closed position of FIG. 4, the rib assembly has to assume a position as shown in FIG. 3 where not only the end rib 6 is forcibly bent but also the pivotal joints *a*, *b*, *c* and *d* undergo excessive loads possibly to result in breakage. Furthermore, the main rib 3 is violently pressed against the center rod 1 and sometimes possibly projected to the other side of the center rod 1 beyond the center line thereof, preventing the normal operation of the rib assembly.

It is therefore an object of the present invention to provide a folding umbrella of the type as mentioned above and provided with means for varying the distance in a straight line between the ends of the auxiliary link to eliminate the difficulty in operation for collapsing the rib assembly from the uncollapsed closed position to the collapsed closed position.

SUMMARY OF THE INVENTION

According to the present invention, there is provided a folding umbrella, comprising a contractile center rod movable between a collapsed storage position and an extended use position; a ferrule fixedly secured to the center rod directly adjacent the upper end thereof; a runner slidably mounted on said center rod intermediate the ends thereof; a collapsible rib assembly movable between a collapsed storage position and an extended position, said rib assembly including a main rib, an end rib, a connecting link, an auxiliary link and a strut; said main rib having the upper end thereof pivotally connected to said ferrule and the lower end thereof pivotally connected to the inner end of said auxiliary link; said end rib being carried by the outer end of said auxiliary link and spaced from said main rib; said auxiliary link consisting of an inner and an outer link member pivotally connected with each other to make the auxiliary link foldable at the pivotal joint in the course of the movement from the extended position to the collapsed position; said connecting link having the outer end thereof pivotally connected to the upper end of said end rib and the inner end thereof pivotally connected to said main rib at a location disposed between the upper and lower ends of said main rib; said strut being pivotally connected at the inner end thereof to said runner and having the outer end thereof pivotally connected to one of said auxiliary link, said connecting link and said end rib including the pivotal joint thereof;

and means adapted to be brought into abutment against the auxiliary link for restraining the folding of the auxiliary link in the opened position of the umbrella thereby to keep the rib assembly stably in its opened position.

DESCRIPTION OF THE DRAWINGS

The invention will be better understood from the following description taken in connection with the accompanying drawings in which.

Figure 1:
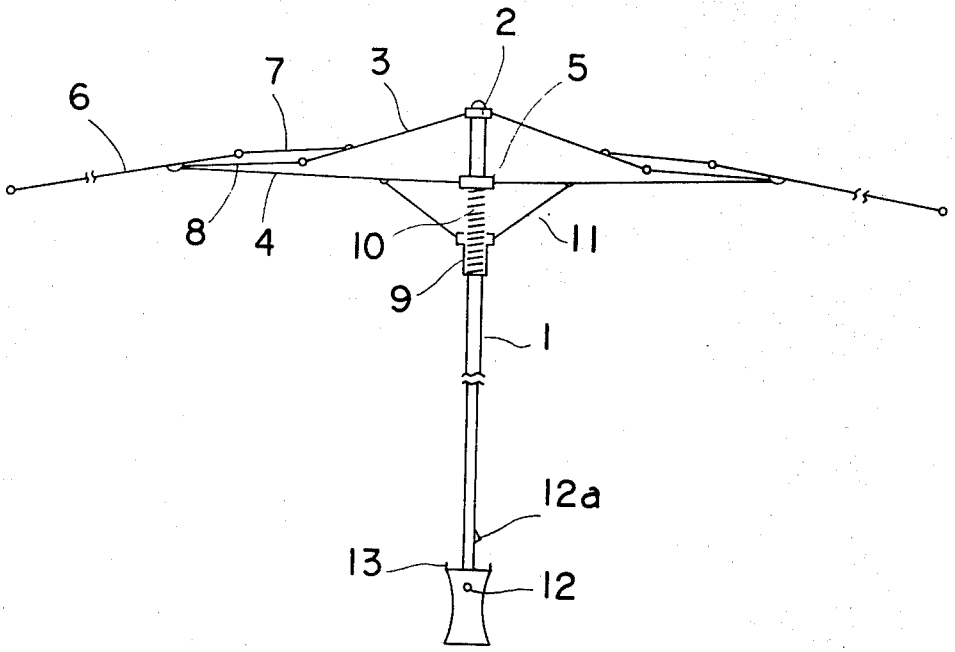
Fig- 1 PRIOR ART
FIG. 1 is a diagrammatical side view of a conventional umbrella, illustrating the opened position thereof.

In the drawings and the following descriptions, like portions or parts are denoted by like numerals or characters and the term "collapse" is used herein to mean that the rib assembly is folded into the contracted state with its end rib folded on its main rib and that the center rod is also contracted, whereas the term "uncollapsed position" herein means a state of the rib assembly in which it is closed keeping its end rib extended with reference to its main rib and its center rod extended.

Figure 4:
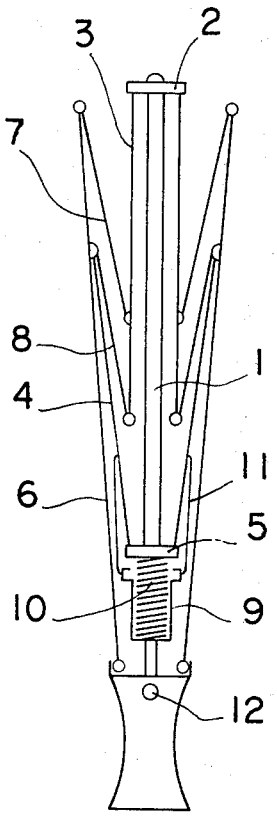
Fig-4 PRIOR ART
FIG. 4 is a diagrammatical side view of the conventional umbrella shown in FIG. 1, illustrating the collapsed closed position thereof.
Figure 3:
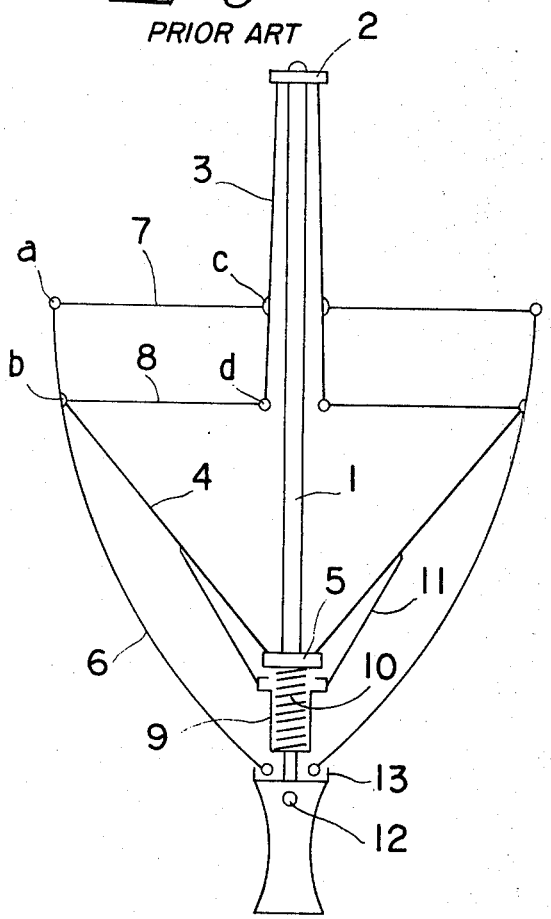
Fig-3 PRIOR ART
FIG. 3 is a diagrammatical side view of the conventional umbrella shown in FIG. 1, illustrating the position thereof in the course of the movement from the uncollapsed closed position to the collapsed closed position.
Figure 5:
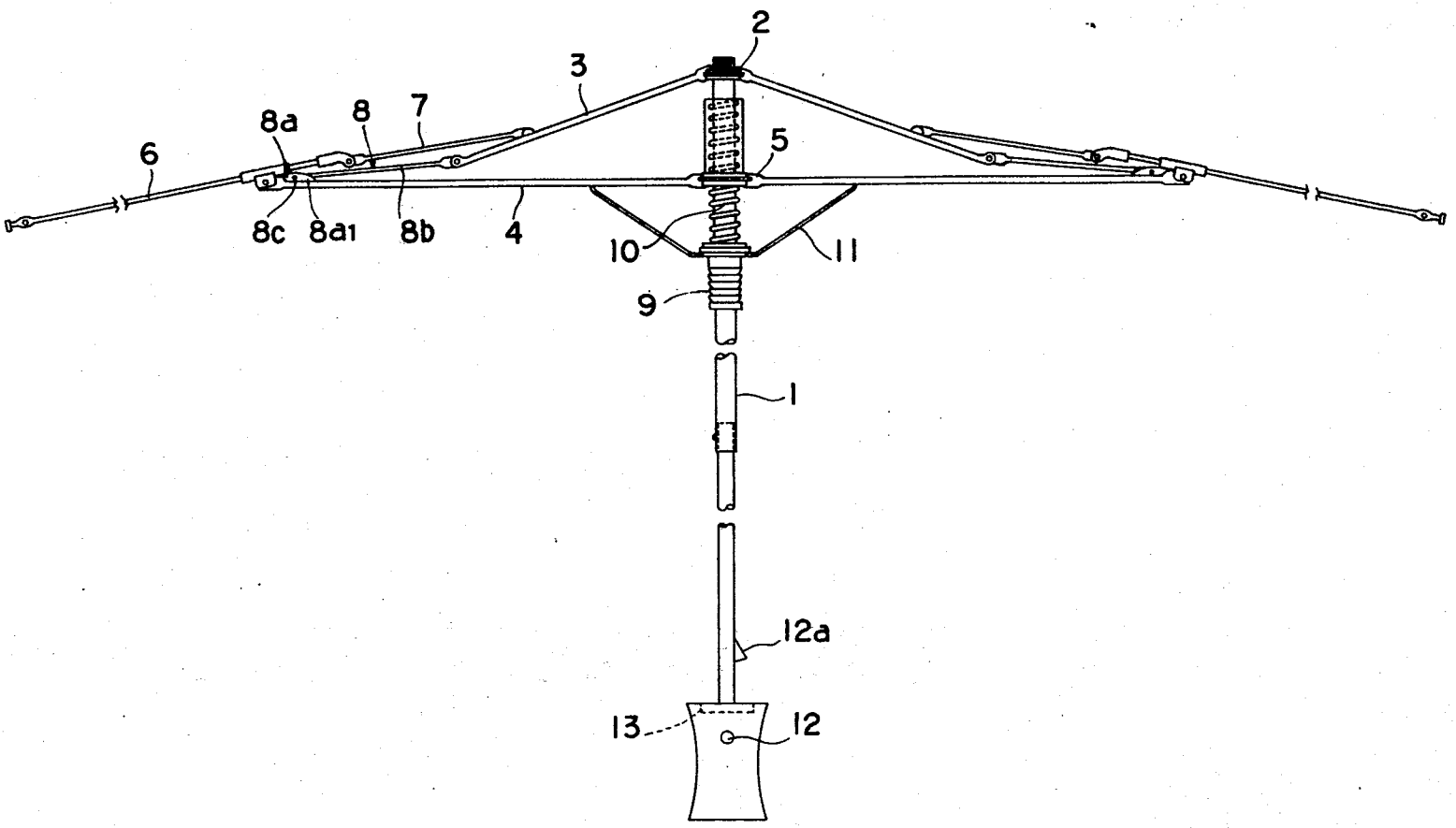
FIG. 5 is a side view of one form of the umbrella according to the present invention, illustrating the opened position thereof.
Figure 8:
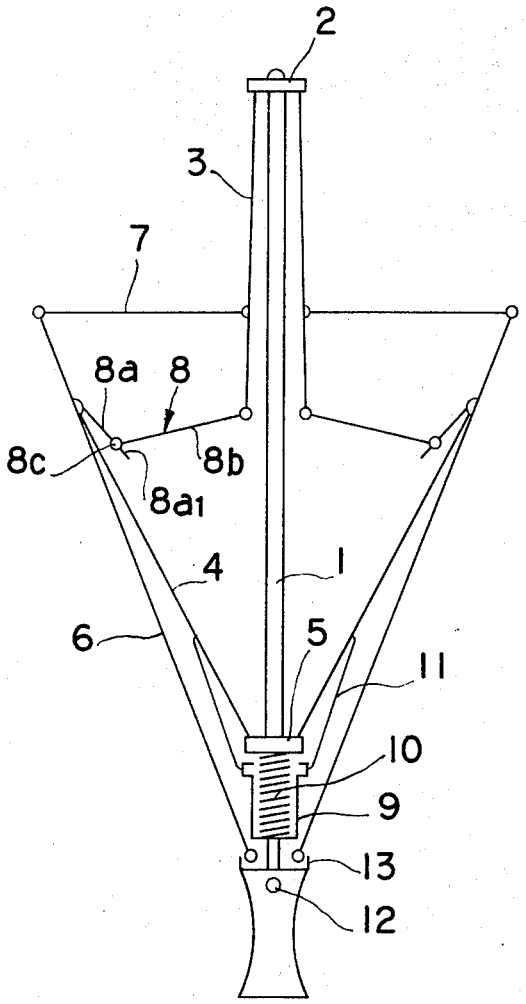
FIG. 8 is a diagrammatical side view of FIG. 1, illustrating the position thereof in the course of the movement from the uncollapsed closed position to the collapsed closed position.

Referring now to FIG. 5, there is illustrated one form of the umbrella according to the present invention in its opened position. This umbrella is constructed substantially identically with the conventional umbrella, as shown in FIGS. 1 through 4, except the structure of an auxiliary link 8. The auxiliary link 8 is formed of two parts, namely outer link member 8*a* and inner link member 8*b* which are articulated at 8*c*. The outer link member 8*a* is formed in a U-shape and the inner link member 8*b* is made of wire material. The outer end of the link member 8*b* is pivotally connected to the link member 8*a*, intermediate the ends thereof, so that the auxiliary link 8 can be freely folded into a V-shape as viewed in FIG. 8 but it is kept from being folded into an inverted V-shape due to the abutment of an extension $8a_1$ of the outer link member 8*a* extending inwardly from the pivotal joint 8*c* against the inner link member 8*b* to keep the rib assembly stably in its opened position. In order to keep the rib assembly stably in its opened position, there is further provided means for holding the auxiliary link 8 to restrain its folding. In case the outer end of the strut 4 is connected to the pivotal joint of the auxiliary link 8 and the end rib 6, the end rib 6 at a position in the vicinity of and outward from said pivotal joint, or the outer link member 8*a* of the auxiliary link 8 where said strut 4 is capable of engaging the auxiliary link 8, especially the outer link member 8*a* in the opened position of the umbrella, such a holding means is provided on said strut 4 at a position engageable with said auxiliary link 4 in the opened position. For example, the strut 4 is formed in a U-shape at its position as mentioned above to snugly receive therein said auxiliary link, especially its outer link member 8*a* so that the strut can hold the auxiliary link 8 to restrain its further folding. In case the outer end of the strut 4 is connected to the end rib 6 at a position inward from said pivotal joint, the strut 4 may be formed in Y-shape straddling and receiving the auxiliary link 8 to hold the outer link member 8*a* of the auxiliary link 8 in the opened position or the strut 4 may be provided with a projection to support the outer link member 8*a* in the opened position.

In this connection, it is to be noted that the outer link member 8*a* and its extension $8a_1$ may be formed in an inverted U-shape. In this case, the auxiliary link 8 can be folded into an inverted V-shape as viewed from FIG. 8 and the holding means may be provided on the connecting link, holding and pressing said auxiliary link 8 to restrain the folding thereof in a V-shape. In this embodiment, the outer end of the strut 4 may be connected to any one of the end rib 6, the connecting link 7 and the auxiliary link 8 including the pivotal joints of the end rib 6 and the auxiliary link 8, and the end rib 6 and the connecting link 7.

Figure 7:
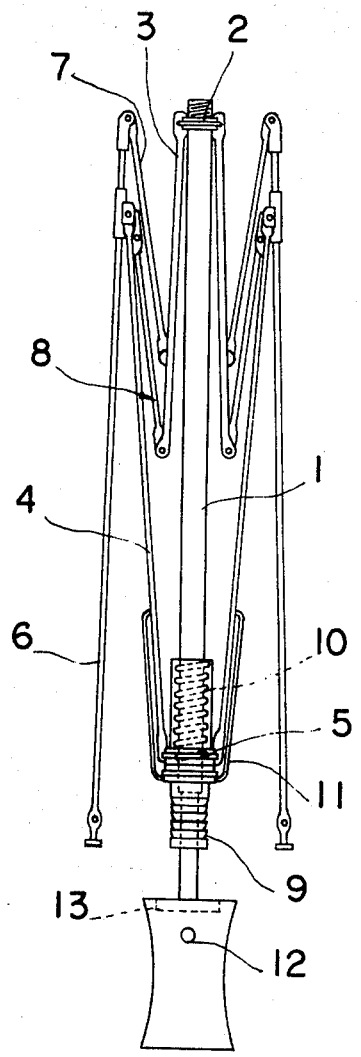
FIG. 7 is a side view of the umbrella shown in FIG. 1, illustrating the collapsed closed position thereof.
Figure 6:
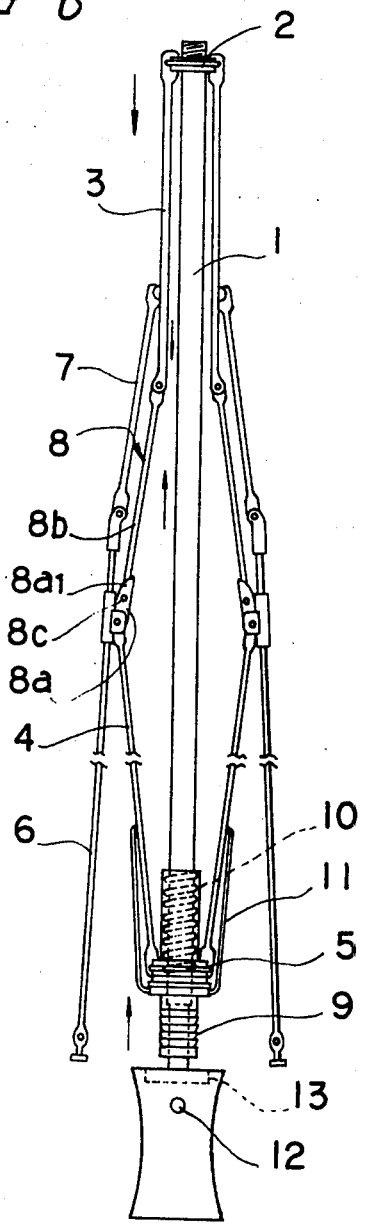
FIG. 6 is a side view of the umbrella shown in FIG. 5, illustrating the uncollapsed closed position thereof.

It will thus be seen that when the rib assembly is moved from the uncollapsed closed position of FIG. 6 to the collapsed closed position of FIG. 7, the inward pressure applied by the end rib 6 is cancelled by or balanced with the folding of the auxiliary link 8 at 8*c* and the rib assembly can be moved easily and smoothly to the position of FIG. 7 without receiving unnecessary resistance.

Though the foregoing description is given referring to the umbrella provided with the automatic opening means, the present invention is also applicable with a great advantage to a so-called non-automatic umbrella of this type.

Figure 2:
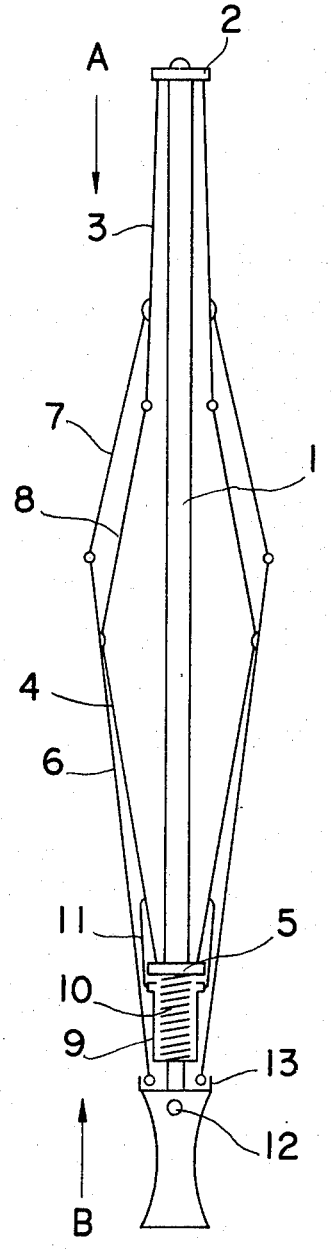
Fig-2 PRIOR ART
FIG. 2 is a diagrammatical side view of the conventional umbrella shown in FIG. 1, illustrating the uncollapsed closed position thereof.

In a conventional non-automatic umbrella, first the end rib 6 must be released from the receiving means 13, second, the runner 5 must be raised to move the rib assembly alone into the collapsed closed position, third, the center rod 1 must be contracted and then, the tip end of the rib must be again put into the receiving means 13 to collapse the umbrella from the position of FIG. 2 to the position of FIG. 4.

Whereas, the non-automatic umbrella embodying the present invention is capable of being collapsed from the position of FIG. 2 to the position of FIG. 4 through one operation by applying a force to the rib assembly in the arrow directions in FIG. 2.

As mentioned above, the present invention can provide such a great advantage to either the umbrella with the automatic opening means or the so-called non-automatic umbrella since the umbrella can be collapsed smoothly and easily from the uncollapsed closed position.

It is further noted that in the rib assembly of the present invention, at least one of the pivotal joints *a*, *b*, *c* and *d* may be formed slidable, varying the or each length of the sides of the quadrilateral formed by the main rib, the end rib, the connecting link and the auxiliary link to control the coutour of the umbrella in its opened position.

What is claimed is:

1. A folding umbrella, comprising:

a contractile center rod movable between a collapsed storage position and an extended use position;

a ferrule fixedly secured to the center rod directly adjacent the upper end thereof;

a runner slidably mounted on said center rod intermediate the ends thereof;

a collapsible rib assembly movable between a collapsed storage position and an extended position, said rib assembly including a main rib, and end rib, a connecting link, an auxiliary link and a strut;

said main rib having the upper end thereof pivotally connected to said ferrule and the lower end thereof pivotally connected to the inner end of said auxiliary link;

said end rib being carried by the outer end of said auxiliary link and spaced from said main rib;

said auxiliary link consisting of a inner and an outer link member pivotally connected with each other to make the auxiliary link foldable at the pivotal joint in the course of the movement from the extended position to the collapsed position;

said connecting link having the outer end thereof pivotally connected to the upper end of said end rib and the inner end thereof pivotally connected to said main rib at a location disposed between the upper and lower ends of said main rib;

said strut being pivotally connected at the inner end thereof to said runner and having the outer end thereof pivotally connected to one of said auxiliary link, said connecting link and said end rib including the pivotal joint thereof; and means adapted to be brought into abutment against the auxiliary link for restraining the folding of the auxiliary link in the opened position of the umbrella thereby to keep the rib assembly stably in its opened position.

2. A folding umbrella as set forth in claim 1, which further comprises an automatic opening means having an actuator slidably mounted on the center rod under the runner, a spring resting at its upper end against said runner and at its lower end against said actuator, and an actuator strut connected between said actuator and the auxiliary link.

3. A folding umbrella as set forth in claim 1, wherein said means for restraining the folding of the auxiliary link includes means for regulating the direction of the folding of the auxiliary link and means for holding the auxiliary link in the opened position of the umbrella.

4. A folding umbrella as set forth in claim 3, wherein said outer end of the strut is pivotally connected to one of the end rib and the outer link member of the auxiliary link including the pivotal point of the end rib and the auxiliary link, at a position where said strut is brought into contact with said auxiliary link in the opened position of the umbrella; said means for regulating the direction of the folding of the auxiliary link is formed as an extension of said outer link member extending inwardly from the pivotal joint thereof with the inner link member and made of a U-shaped material to receive therein said inner link member and to prevent the auxiliary link from being folded into an inverted V-shape; and said means for supporting the auxiliary link in the opened position of the umbrella is provided on the strut at a position confronting said auxiliary link and in engagement with the outer link member of the auxiliary link in the opened position, supporting said outer link member to restrain the folding of the auxiliary link in said opened position.

5. A folding umbrella as set forth in claim 3, wherein said outer end of the strut is pivotally connected to the end rib at a position inner than the pivotal joint with the auxiliary link; said means for regulating the folding direction of the auxiliary link is formed as an extension of the outer link member of the auxiliary link extending inwardly from the pivotal joint thereof with the inner link member and made of a U-shaped material to receive therein said inner link member and to prevent the auxiliary link from being folded into an inverted V-shape; and said means for supporting the auxiliary link in the opened position of the umbrella is provided on the strut and adapted to engage with the outer link member of the auxiliary link in the opened position, holding said outer link member to restrain the folding of the auxiliary link in said opened position.

6. A folding umbrella as set forth in claim 3, wherein said means for regulating the folding direction of the auxiliary link is formed as an extension of the outer link member extending inwardly from the pivotal joint thereof with the inner link member and made of an inverted U-shaped material to receive therein said inner link member and to prevent the auxiliary link from being folded into a V-shape; and said means for supporting the auxiliary link in the opened position of the umbrella is provided on the connecting link at a position confronting said auxiliary link and in engagement therewith in the opened position, pressing said auxiliary link to restrain the folding of the auxiliary link in said opened position.

* * * * *